US012320592B2

(12) United States Patent
Bandyopadhyay et al.

(10) Patent No.: US 12,320,592 B2
(45) Date of Patent: Jun. 3, 2025

(54) VAPOR CHAMBER DEVICES AND METHODS OF DISSIPATING HEAT THEREWITH

(71) Applicant: Purdue Research Foundation, West Lafayette, IN (US)

(72) Inventors: Soumya Bandyopadhyay, West Lafayette, IN (US); Amy Marie Marconnet, West Lafayette, IN (US); Justin A. Weibel, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 501 days.

(21) Appl. No.: 17/330,842

(22) Filed: May 26, 2021

(65) Prior Publication Data

US 2021/0372709 A1 Dec. 2, 2021

Related U.S. Application Data

(60) Provisional application No. 63/030,064, filed on May 26, 2020.

(51) Int. Cl.

| | |
|---|---|
| ***F28D 15/00*** | (2006.01) |
| ***F28D 15/02*** | (2006.01) |
| ***F28D 15/04*** | (2006.01) |

(52) U.S. Cl.

CPC ..... *F28D 15/0266* (2013.01); *F28D 15/04* (2013.01)

(58) Field of Classification Search

CPC ..... F28D 15/02; F28D 15/04; F28D 15/0266; F28D 15/0275

See application file for complete search history.

(56) References Cited

U.S. PATENT DOCUMENTS

2006/0237167 A1* 10/2006 Lee ..... F28D 15/046 165/104.26
2017/0347489 A1* 11/2017 Lan ..... F28D 15/0233
2018/0356162 A1* 12/2018 Sun ..... B23K 37/06

FOREIGN PATENT DOCUMENTS

JP 2017072340 A * 4/2017
KR 20190091679 A * 8/2019

OTHER PUBLICATIONS

Sudhakar, S.,et al., "Area-Scalable High-Heat-Flux Dissipation At Low Thermal Resistance Using A Capillary-Fed Two-Layer Evaporator Wick", International Journal of Heat and Mass Transfer 135 (2019) pp. 1346-1356.

(Continued)

*Primary Examiner* — Harry E Arant

(74) *Attorney, Agent, or Firm* — Hartman Global IP Law; Gary M. Hartman; Domenica N.S. Hartman

(57) ABSTRACT

A vapor chamber device having a first vapor core configured to passively spread heat from a localized first input area to a relatively larger first output area adjacent to and in thermal contact with a heat output side of the vapor chamber device, and a second vapor core configured to passively spread heat from a localized second input area adjacent to and in thermal contact with a heat input side of the vapor chamber device to a relatively larger second output area in thermal contact with the first input area of the first vapor core. The second vapor core is configured to attenuate high heat flux hotspots on the first input area before the heat fluxes thereof pass through the second output area of the second vapor core to the first input area of the first vapor core.

11 Claims, 9 Drawing Sheets

(56) References Cited

OTHER PUBLICATIONS

Sudhakar, S., et al., "The Role of Vapor Venting and Liquid Feeding On the Dryout Limit of Two-Layer Evaporator Wicks", International Journal of Heat and Mass Transfer 148 (2020) p. 6.

* cited by examiner

VAPOR CHAMBER DEVICES AND METHODS OF DISSIPATING HEAT THEREWITH

CROSS REFERENCE TO RELATED APPLICATIONS

This application claims the benefit of U.S. Provisional Application No. 63/030,064 filed May 26, 2020, the contents of which are incorporated herein by reference.

BACKGROUND OF THE INVENTION

The present invention generally relates to thermal management processes and equipment. The invention particularly relates to vapor chamber devices capable of spreading heat, including heat from sources that generate large total heat loads and/or high-power-density hotspots.

Vapor chamber devices have long been used in thermal management applications. Such devices passively spread heat from a localized input area to a relatively larger output area, where the heat can then be rejected, as nonlimiting examples, to a heat sink or cold plate. As a nonlimiting example, when applied to thermal management of electronic devices, vapor chamber devices can be subjected to non-uniform power maps that include hotspots (discrete areas with high heat fluxes). Vapor chamber devices typically comprise a vacuum-sealed envelope or housing having an internal cavity therein that stores a working fluid (e.g., water). The cavity is lined on its interior by porous wick structures that define what is referred to as a vapor core that generates a capillary pressure to recirculate the working fluid between cooler and warmer areas of the housing (e.g., an evaporator side and a condenser side).

As a nonlimiting example, use of such vapor chamber devices may include positioning the device such that a bottom surface thereof thermally contacts a heat source and a top surface thereof thermally contacts a heat sink. As the heat is conducted from the heat source to the vapor chamber device, some of the working fluid vaporizes and travels to cooler areas such as internal surfaces of the top surface. The heat sink absorbs heat at the top surface causing the vaporized working fluid to condense and return to liquid form. This liquid working fluid is then reabsorbed by the wick structures and distributed through capillary action to warmer areas such as internal surfaces of the bottom surface where the cycle repeats. As used herein, a portion of the porous wick structure adjacent the heat input area where the working fluid vaporizes due to heat absorption is referred to as an evaporator wick, and a portion of the porous wick structure adjacent the heat output area where the working fluid condenses due to heat rejection is referred to as a condenser wick.

In a conventional vapor chamber device having a single vapor core, there is a design tradeoff between increased power handling (via increased liquid feeding) and reduced conduction thermal resistance. Conventional vapor chamber devices having a single vapor core require a relatively thick evaporator wick to avoid a capillary limit at high total heat loads. Even though high heat flux hotspots may contribute only a small portion of the total power, as the thickness of the evaporator wick is increased to handle higher total heat loads, a dramatic increase in the temperature of the hotspots may occur due to an increased conduction resistance across the evaporator wick.

Recent investigations reported in the literature have focused on the structure of the evaporator wick within a vapor chamber device to address the removal of high heat fluxes over differing heat input areas. Several of these studies focus on the development of hybrid or micro-patterned wick structures that aim to maintain low surface temperatures and adequately feed liquid over relatively large areas of the evaporator wick having uniform heat fluxes. However, previous evaporator wicks and vapor chamber designs have not been developed or demonstrated with the goal of simultaneously managing both high total powers (over large areas) and randomly located hotspots, despite the importance and prevalence of this power map.

BRIEF DESCRIPTION OF THE INVENTION

The present invention provides vapor chamber devices suitable for use in thermal management applications and methods for their use.

According to one aspect of the invention, a vapor chamber device having a heat input side and a heat output side includes a first vapor core configured to passively spread heat from a localized first input area to a relatively larger first output area adjacent to and in thermal contact with the heat output side of the vapor chamber device, and a second vapor core configured to passively spread heat from a localized second input area adjacent to and in thermal contact with the heat input side of the vapor chamber device to a relatively larger second output area in thermal contact with the first input area of the first vapor core. The first vapor core and the second vapor core are sealed from each other and hydraulically independent. The second vapor core is configured to attenuate high heat flux hotspots on the first input area before the heat fluxes thereof pass through the second output area of the second vapor core to the first input area of the first vapor core.

According to another aspect of the invention, a vapor chamber device includes a cascaded multi-core unit having a top-tier subunit comprising a first sealed cavity lined on an interior thereof by a first porous wick structure that defines a single first vapor core configured to generate a capillary pressure to recirculate a first working fluid therein and thereby passively spread heat from a localized first input area to a relatively larger first output area of the top-tier subunit, and a bottom-tier subunit comprising a second sealed cavity lined on an interior thereof by a second porous wick structure that defines at least a second vapor core configured to generate a capillary pressure to recirculate a second working fluid therein and thereby passively spread heat from a localized second input area to a relatively larger second output area of the bottom-tier subunit. The second output area of the bottom-tier subunit is thermally coupled to the first input area of the top-tier subunit. The second vapor core is configured to attenuate high heat flux hotspots before the heat fluxes thereof pass through the second output area of the bottom-tier subunit to the first input area of the top-tier subunit.

According to yet another aspect of the invention, a method is provided for dissipating heat from a surface with a vapor chamber device having a cascaded multi-core unit comprising a top-tier subunit comprising a first sealed cavity lined on an interior thereof by a first porous wick structure that defines a single first vapor core containing a first working fluid therein, and a bottom-tier subunit comprising a second sealed cavity lined on an interior thereof by a second porous wick structure that defines at least a second vapor core containing a second working fluid therein. The method includes locating a heat input side of the vapor chamber device onto the surface, conducting heat to a second input area of the bottom-tier subunit and thereby vaporizing the second working fluid within the second vapor core and rejecting heat from a second output area of the bottom-tier subunit that is relatively larger than the second input area and thereby condensing the second working fluid within the second vapor core, generating a capillary pressure within the second vapor core to recirculate the second working fluid therein and thereby passively spread heat from the second input area to the second output area of the bottom-tier subunit, conducting heat from the second output area of the bottom-tier subunit to a first input area of the top-tier subunit and thereby vaporizing the first working fluid within the first vapor core and rejecting heat from a first output area of the top-tier subunit that is relatively larger than the first input area and thereby condensing the first working fluid within the first vapor core, generating a capillary pressure within the first vapor core to recirculate the first working fluid therein and thereby passively spread heat from the first input area to the first output area of the top-tier subunit, and attenuating high heat flux hotspots on the surface with the second vapor core before the heat fluxes thereof pass through the second output area of the bottom-tier subunit to the first input area of the top-tier subunit.

Technical aspects of the vapor chamber devices and the method described above preferably include the capability of decoupling the spreading of total background power from that of individual hotspots using a single top-tier subunit for bulk heat spreading and a bottom-tier subunit for damping of high heat fluxes. The vapor chamber devices offer significant potential enhancement in performance, possibly on the order of a magnitude lower in thermal resistance, compared to conventional solid copper heat spreaders and conventional single-core vapor chamber devices owing to a reduction in the conduction resistance across the internal wick structure.

Other aspects and advantages of this invention will be appreciated from the following detailed description.

BRIEF DESCRIPTION OF THE DRAWINGS

FIG. 3A schematically represents cross-sectional and bottom views of heat transfer from the heat generating die. The die consists of a region with a low background heat flux (light area) with a small hotspot at the center (dark spot). The dashed box represents a location for one of three heat spreaders that spread heat from the die to a heat sink (not shown). FIGS. 3B, 3C, and 3D represent cross-sectional views of a solid copper device, a conventional single-core vapor chamber device, and a cascaded, multi-core vapor chamber device, respectively. FIG. 3D further includes an inset that schematically represents a magnified view of the bottom-tier subunit of the cascaded multi-core vapor chamber device and an array of secondary vapor cores therein.

FIGS. 8A and 8C) and maximum thermal resistances ($R_{sp,t}$, $R_{sp,b}$; FIGS. 8B and 8D) for the top-tier and bottom-tier subunits of the cascaded multi-core vapor chamber device of FIGS. 1, 2, and 3D as a function of wick porosities ($e_t$, $e_b$) and particle diameters ($D_t$, $D_b$) for total tier thicknesses $t_t$=1.4 mm and $t_b$=0.6 mm. The regions (Rg) to the left and right of the light dashed lines in FIGS. 8A and 8C correspond to the capillary-limit-governed wick thickness ($Rg_{cap}$: $t_{wick,t}=t_{cap,t}$; $t_{wick,b}=t_{cap,b}$) and the particle diameter-governed wick thickness ($Rg_D$: $t_{wick,t}=3D_t$; $t_{wick,b}=3D_b$), respectively. The darker dashed lines in FIGS. 8B and 8D denote the porosities ($e_t$, $e_b$) for which the thermal resistances ($R_{sp,t}$, $R_{sp,b}$) are believed to be at a minimum for any given particle diameters ($D_t$, $D_b$). The points believed to be of optimal thermal resistance for the top-tier and bottom-tier subunits of the cascaded multi-core vapor chamber device of FIGS. 1, 2, and 3D are denoted by white dots labeled $R_{sp,t,opt}$ and $R_{sp,b,opt}$ in FIGS. 8B and 8D, respectively.

DETAILED DESCRIPTION OF THE INVENTION

Existing vapor chamber device designs generally lack the capability of efficiently managing power maps in which both high total powers (over large areas) and small hotpots appear simultaneously. To address, disclosed herein are vapor chamber devices capable of spreading heat from sources that may generate large total heat loads and/or high-power-density hotspots. According to certain nonlimiting aspects of the invention, such vapor chamber devices include a cascaded multi-core unit that includes at least two tiers of cascaded vapor cores, with a top-tier subunit having a vapor core for bulk heat spreading and a bottom-tier subunit with multiple vapor cores for damping of local hotspots that may be generated anywhere over a footprint area thereof. The bottom tier, which covers the footprint of the heat source, contains an array of vapor cores that are designed to spread the high heat fluxes originating from the individual hotspots to a slightly larger area (approximately the size of one core). The bottom tier thus attenuates the high hotspot fluxes while imposing a small conduction resistance across the thin wicks before heat is transferred into the top tier.

Figure 1:
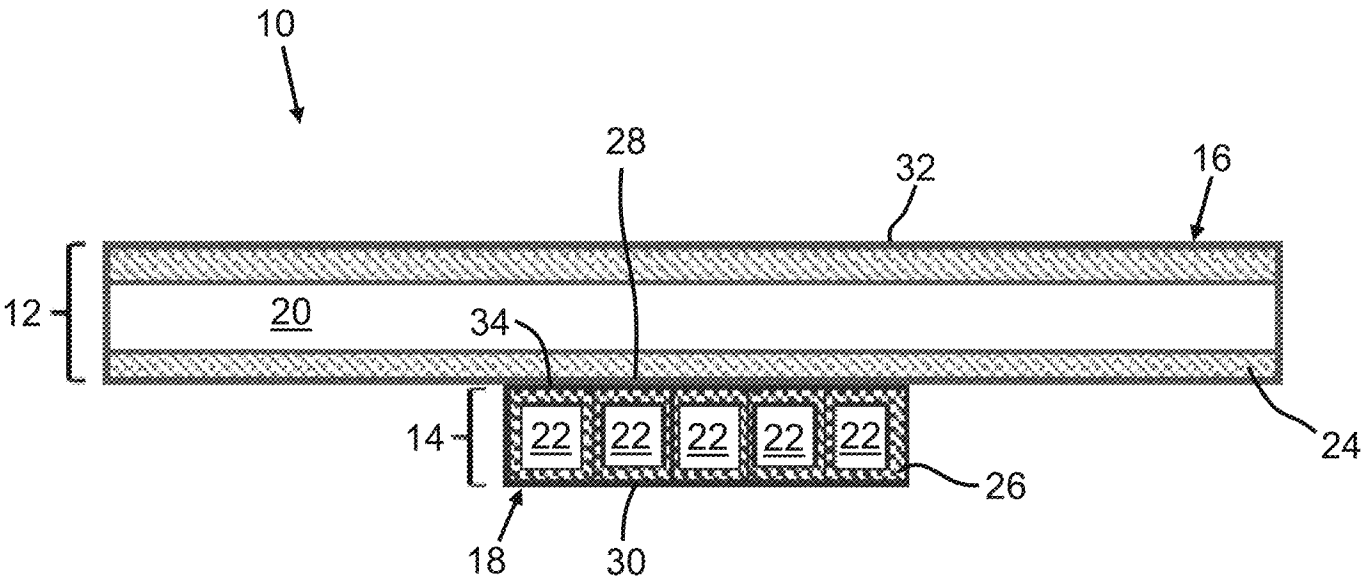
FIG. 1 represents a cross-sectional view of a vapor chamber device that includes a cascaded multi-core unit having a top-tier subunit and a bottom-tier subunit in accordance with certain nonlimiting aspects of the invention.

FIG. 1 represents a nonlimiting vapor chamber device 10 that includes a cascaded multi-core unit having a top-tier subunit 12 and a bottom-tier subunit 14. The top-tier subunit 12 includes a first housing 16 having walls that enclose a first sealed cavity lined on an interior thereof by a first internal porous wick structure 24 that defines a single, primary vapor core 20 configured to generate a capillary pressure to recirculate a first working fluid within the housing 16 and thereby passively spread heat from a localized first input area 28 to a relatively larger first output area 32 of the top-tier subunit 12. The bottom-tier subunit 14 includes a second housing 18 having walls that enclose a second sealed cavity lined on an interior thereof by a second internal porous wick structure 26 that defines an array of multiple secondary vapor cores 22 each individually configured to generate a capillary pressure to recirculate a second working fluid within the housing 18 and thereby passively spread heat from respective portions of a localized second input area 30 to respective portions of a relatively larger second output area 34 of the bottom-tier subunit. The first input area 28 of the top-tier subunit 12 is thermally coupled to the second output area 34 of the bottom-tier subunit 14. However, the top-tier and bottom-tier subunits 12 and 14 are sealed from one another and hydraulically independent. Although the bottom-tier subunit 14 is represented as having a total of five discrete secondary vapor cores 22, the bottom-tier subunit 14 could include fewer or more secondary vapor cores 22.

Figure 2:
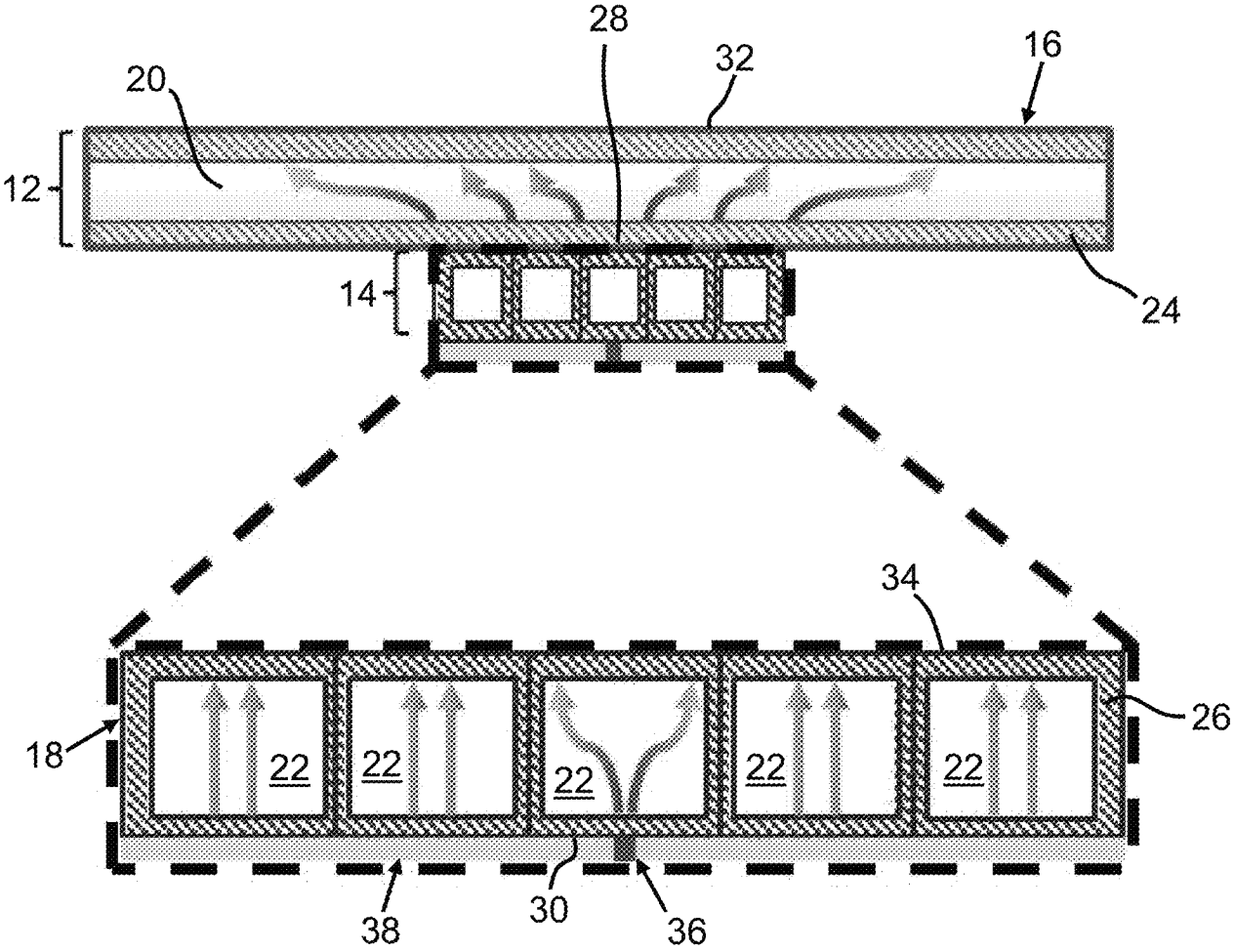
FIG. 2 includes a cross-sectional view of the vapor chamber device of FIG. 1 schematically representing heat flow through top-tier and bottom-tier subunits in accordance with certain nonlimiting aspects of the invention, and an inset schematically representing a magnified view of the bottom-tier subunit and an array of secondary vapor cores therein. The background heat input is represented as being conducted over an entire width of the bottom-tier subunit (light area) whereas a localized smaller hotspot is being conducted by only one of the secondary vapor cores (dark spot) in thermal contact therewith.

FIG. 2 schematically represents a nonlimiting example of heat dissipation through the top-tier and bottom-tier subunits 12 and 14. Heat generated from a heat source is represented as conducting through the second input area 30 of the bottom-tier subunit 14. The heat generated in this example includes a high total heat load 38 spread over a relatively large area and a hotspot 36 concentrated in a relatively small area. The dissipated heat is represented by arrows through the various vapor cores 20 and 22. In this embodiment, the top-tier subunit 12 is configured to spread the total heat load 38 to a significantly larger base area, for example, a surface of a heat sink mounted to the first output area 32, similar to the functionality of a conventional vapor chamber device. The bottom-tier subunit 14 is configured to attenuate high heat flux hotspots, such as hotspot 36, before the heat fluxes thereof pass through the second output area 34 of the bottom-tier subunit 14 to the first input area 28 of the top-tier subunit 12. That is, the array of smaller secondary vapor cores 22 are configured to spread high heat fluxes originating from individual hotspots to a slightly larger area, as represented in the inset of FIG. 2.

Coverage of the heat source with the secondary vapor cores 22 promotes the likelihood that a hotspot formed in any area contacting the second input area 30 will be spread out by the corresponding secondary vapor core 22 located above the hotspot. The small size of each of the secondary vapor cores 22 appreciably reduces a pressure drop of the recirculating second working liquid by minimizing a flow length from condenser wicks to evaporator wicks in each of the secondary vapor cores 22. Consequently, each of the secondary vapor cores 22 in the bottom-tier subunit 14 can sustain operation at the same capillary-limited heat load as the primary vapor core 20 of the top-tier subunit 12, but with significantly thinner evaporator wicks. The bottom-tier subunit 14 thus attenuates the high hotspot fluxes while imposing a small conduction resistance across the thin evaporator wicks before heat is transferred into the top-tier subunit 12, which requires thicker evaporator wicks to manage the total heat load within the capillary limit.

The array of secondary vapor cores 22 are represented in FIGS. 1 and 2 as being of uniform size and shape, having uniform wick thicknesses, and being aligned in a geometric plane that is parallel to a geometric plane aligned with a longitudinal axis of the primary vapor core 20. While this may be preferred in certain applications, the secondary vapor cores 22 could vary in relative size, shape, wick thickness, and alignment. Such structures may be beneficial, for example, in applications in which the heat source has known differences in heat output over its surface area, or applications in which the bottom-tier subunit 14 contacts multiple heat sources with different heat outputs. In addition, the first and second wick structures 24 and 26 may include more complex geometries than those shown, while retaining the benefits of the teachings disclosed herein. Various wick structure geometries are known in the art and will not be discussed in detail herein.

The evaporator wick of the second wick structure 26 of the bottom-tier subunit 14 is preferably thinner than the evaporator wick of the first wick structure 24 of the top-tier subunit 12. That is, the evaporator wick of the second wick structure 26 preferably has a dimension in a direction between the second input area 30 and the second output area 34 that is less than a dimension of the evaporator wick of the first wick structure 24 in a direction from the first input area 28 to the first output area 32. The second wick structure 26 of the bottom-tier subunit 14 preferably has a particle diameter that is lower than the particle diameter of the first wick structure 24 of the top-tier subunit 12. The second wick structure 26 of the bottom-tier subunit 14 also preferably has a path of return for the second working fluid from the second output area 24 to the second input area 30 (e.g., from the condenser wick to the evaporator wick) that is smaller than a path of return for the first working fluid of the first wick structure 24 of the top-tier subunit 12 from the first output area 32 to the first input area 28.

The vapor chamber device 10 and its components may be formed of various materials, such as but not limited to those known in the art for conventional vapor chamber devices. In addition, the materials used for the components of the top-tier subunit 12 and the bottom-tier subunit 14 may differ. A nonlimiting example includes forming the walls of the housing 16 from copper, forming the wick structures 24 and 26 from porous sintered copper, and using water as the working fluids.

The vapor chamber device 10 provides for methods of dissipating heat from a heat generating surface in various applications. The methods may include locating the cascaded multi-core unit onto the surface, specifically such that the second input surface 30 of the bottom-tier subunit 14 contacts the surface or is thermally coupled with and therefore capable of conducting heat from the surface. Once in this location, the vapor chamber device 10 may be used to conduct heat from the surface, through the second input area 30, and into the cavity of the bottom-tier subunit 14 and thereby vaporize the second working fluid within one or more of the secondary vapor cores 22. The heat of the vapor is rejected at the second output area 34 causing the second working fluid to condense into liquid form. A capillary pressure is generated within the one or more secondary vapor cores 22 to recirculate the second working fluid therein from a condenser side to an evaporator side of the secondary vapor cores 22 and thereby passively spread heat from the second input area 30 to a relatively larger second output area 34 of the bottom-tier subunit 14.

Heat may then be conducted from the second output area 34 of the bottom-tier subunit 14, through the first input area 28 of the top-tier subunit 12, and into the cavity of the top-tier subunit 12 and thereby vaporize the first working fluid within the primary vapor core 20. The heat of the vapor is rejected at the first output area 32 causing the first working fluid to condense into liquid form. A capillary pressure is generated within the primary vapor core 20 to recirculate the first working fluid therein from a condenser side to an evaporator side of the primary vapor core 20 and thereby passively spread heat from the first input area 28 to the relatively larger first output area 32. Heat may be conducted from the first output area 32 to a heat dissipating surface such as but not limited to a surface of a heat sink mounted to the first output area 32.

In this manner, the bottom-tier subunit 14 may be used to attenuate high heat flux hotspots on the heat generating surface with the secondary vapor cores 22 before the heat fluxes thereof pass through the second output area 34 of the bottom-tier subunit 14 to the first input area 28 of the top-tier subunit 12. Attenuation of the hotspot heat fluxes within the bottom-tier subunit 14, whose secondary vapor cores 22 have relatively thin evaporator wicks, thereby avoids a large thermal resistance that would be otherwise incurred by directly subjecting the much thicker evaporator wick in the top-tier subunit 12 to hotspots.

Nonlimiting embodiments of the invention will now be described in reference to experimental investigations leading up to the invention.

Figure 3A:
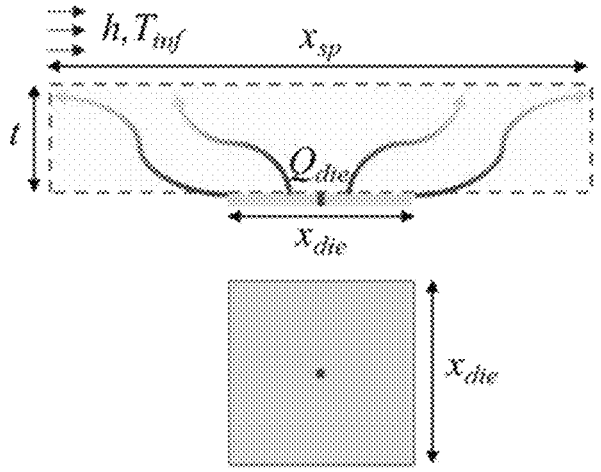
FIGS. 3A through 3D represent a heat generating die and three exemplary heat spreaders used to dissipate heat from the die in experimental investigations leading to aspects of the present invention.
Figure 3B:
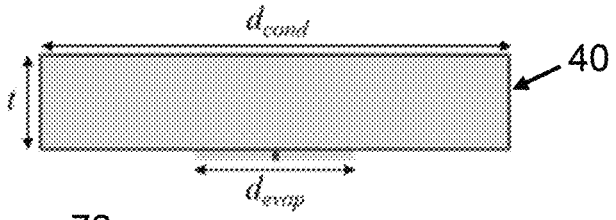
Figure 3C:
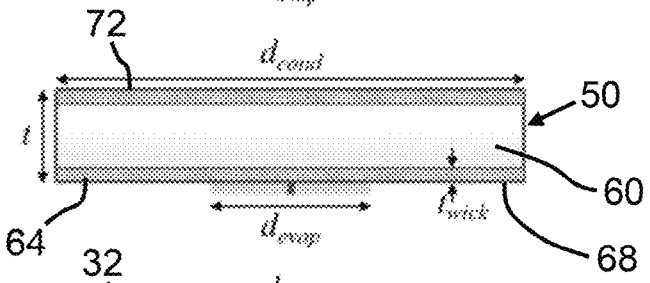
Figure 3D:
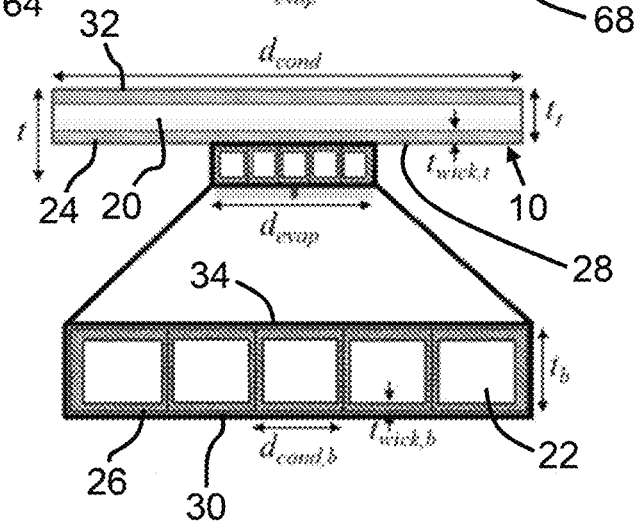

A reduced-order model was developed to evaluate thermal resistance of different intra-lid heat spreaders including, for example, a solid copper device 40 (FIG. 3B) used as a benchmark, a conventional vapor chamber device 50 (FIG. 3C), and the vapor chamber device 10 (FIG. 3D).

For a fair comparison, the design envelope and power map were kept fixed across all of the heat spreaders 10, 40, and 50, while the remaining free design parameters were adjusted independently for each heat spreader type. All parameters varied during parametric design are shown in FIGS. 3B through 3D, including the fixed equivalent design envelope parameters ($d_{evap}$, $d_{cond}$, and t). The housing constrained the heat spreaders 10, 40, and 50 to have a maximum through-plane thickness (t) of 2 mm within a square cross-section having an edge length ($x_{sp}$) of 55 mm They were all subjected to the same representative nonuniform power map from a square die having an edge length ($x_{die}$) of 25 mm (FIG. 3A). A hotspot heat load ($Q_{hs}$) of 8 W over 1 $mm^2$ (denoted by a darker spot) was located in the center of the die, and the remaining area had a uniform background flux of 0.75 $W/mm^2$ (denoted by a lighter area around the darker spot). For the vapor chamber device 10, the hotspot was centrally located underneath one of the secondary vapor cores 22 of the bottom-tier subunit 14. Because performance of heat spreaders 10, 40, and 50 was influenced by the value of the thermal resistance to heat rejection, for purposes of this investigation, this value was calculated assuming the performance of a typical air-cooled heatsink attached to the heat spreaders 10, 40, and 50 using a high-performance thermal interface material (TIM). The external thermal resistance ($R_{ext}$=0.15 K/W) from the heat spreader-TIM interface to the reference temperature ($T_{inf}$=300 K) was calculated as:

$$R_{ext}=R_{TIM}+R_{cond} \tag{1}$$

This thermal resistance results in an effective heat transfer coefficient (h) of 2250 $W/m^2K$ at the heat spreader-TIM interface. The temperature at the heat spreader-TIM interface can be computed from the total die heat load ($Q_{die}$), as:

$$T_{cond,t}=T_{inf}+Q_{die}R_{ext} \tag{2}$$

The heat spreaders 10, 40, and 50 were modeled as cylindrical disks with effective radii that yield the same equivalent heat input and heat output areas as the rectangular geometry. The solid copper device 40 resistance due to conduction was calculated as a function of the geometry and boundary conditions. The thermal resistance of the vapor chamber devices 10 and 50 for a given uniform heat input was estimated based on one-dimensional conduction across the evaporator wicks and the temperature drop across the vapor cores 20, 22, and 60 due to the saturation pressure difference. The resistance due to phase change at the interface was neglected. For evaluation of the vapor pressure drop, the thermophysical properties were taken at the temperature corresponding to the heat spreader-TIM interface.

For the given non-uniform power map, the maximum die temperature and the corresponding thermal resistance occurred at the hotspot location. To calculate the maximum thermal resistance for the solid copper device 40 and the conventional vapor chamber device 50 ($R_{sp}$), the total heat load of the power map was decomposed into a 468.75 W heat input ($Q_1$) at a uniform flux of 0.75 $W/mm^2$ over the entire die area and a 7.25 W heat input ($Q_2$) over the 1 $mm^2$ hotspot. The total temperature difference between the hotspot and the heat spreader-TIM interface ($\Delta T_{hs}$) was computed from the thermal resistances associated with the decomposed heat inputs, respectively $R_1$ and $R_2$ as estimated from the reduced-order models, using the principle of linear superposition:

$$\Delta T_{hs}=Q_1R_1+Q_2R_2 \tag{3}$$

This net hotspot temperature difference ($\Delta T_{hs}$) and the heat load at the hotspot ($Q_{hs}$) were employed to compute the maximum heat spreader resistance as:

$$R_{sp}=\frac{\Delta T_{hz}}{Q_{hz}} \tag{4}$$

Figure 4:
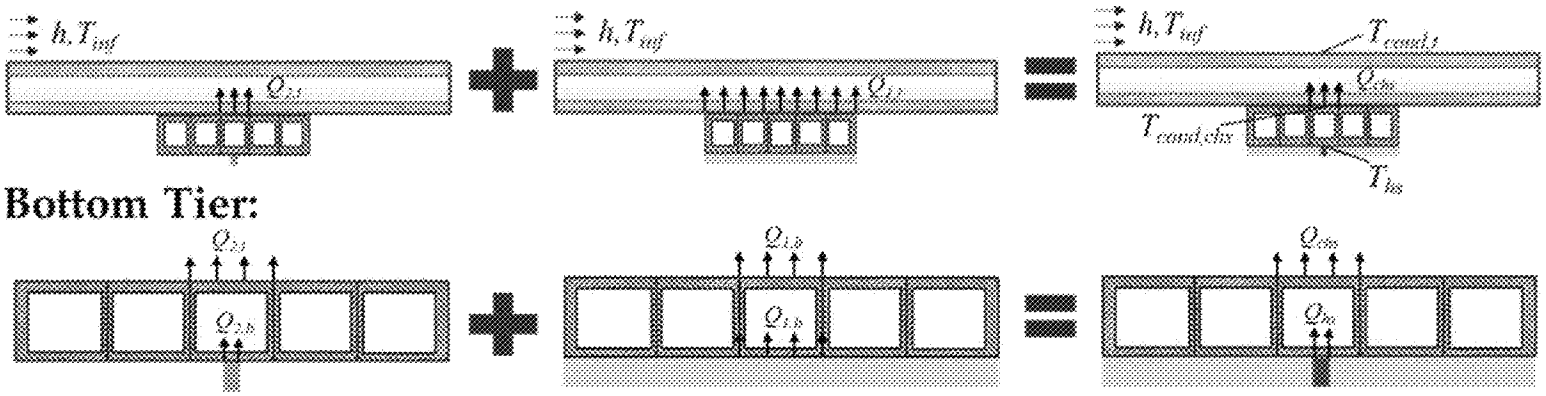
FIG. 4 schematically represents cross-sectional views of the cascaded multi-core vapor chamber device of FIGS. 1, 2, and 3D depicting heat flow paths and heat loads through the bottom-tier subunit (magnified view) into the top-tier subunit in accordance with certain nonlimiting aspects of the invention.

For the bottom-tier subunit 14 that was located directly over the hotspot of the die, it was considered that the total heat input to this bottom-tier subunit 14 was spread uniformly over the condenser wick, and there was a uniform heat flux into the evaporator wick of the top-tier subunit 12 dictated by the cross-sectional area ($A_{cond,b}$) of the bottom-tier subunit 14. FIG. 4 shows the cross-section of the vapor chamber device 10 with the heat flow paths and the heat loads in each tier. The maximum thermal resistance for the bottom-tier subunit 14 ($R_{sp,b}$) was computed by decomposing the total heat load (see FIG. 4) handled by this particular secondary vapor core 22 into a heat input ($Q_{1,b}$) distributed uniformly over the entire vapor core at 0.75 W/mm$^2$ and the concentrated heat input ($Q_{2,b}$) of 7.25 W over the 1 mm$^2$ hotspot 36. The respective thermal resistances, $R_{1,b}$ and $R_{2,b}$, as computed from the reduced-order models, were employed to estimate the total difference between the temperatures of the hotspot ($T_{hs}$) and the condenser side of the bottom-tier subunit 14 ($T_{cond,chs}$), as:

$$T_{hs}-T_{cond,chs}=Q_{1,b}R_{1,b}+Q_{2,b}R_{2,b} \tag{5}$$

This net temperature difference and the total heat input at the hotspot ($Q_{hs}$) were employed to compute the resistance of the bottom-tier subunit 14 as:

$$R_{sp,b} = \frac{T_{hz} - T_{cond,zhz}}{Q_{hz}} \tag{6}$$

$$T_{cond,chs} - T_{cond,t} = Q_{1,t}R_{1,t} + Q_{2,t}R_{2,t} \tag{7}$$

This temperature difference and the heat load for the hotspot ($Q_{hs}$) were employed to compute the thermal resistance of the top-tier subunit as:

$$R_{sp,t} = \frac{T_{cond,chz} - T_{cond,t}}{Q_{hz}} \tag{8}$$

To evaluate the maximum heat spreader thermal resistance ($R_{sp}$) for the vapor chamber device 10 using Eq. (4), the net temperature difference between the hotspot and the condenser wick of the vapor chamber device 10 ($\Delta T_{hs}$) was calculated as:

$$\Delta T_{hs}=T_{hs}-T_{cond,s}=Q_{hs}(R_{sp,b}+R_{sp,t}) \tag{9}$$

The wick structures 28, 30, and 68 of the vapor chamber devices 10 and 50 were designed to have the minimum possible thickness without reaching the capillary limit at the required total heat load; this corresponds to the possible conduction thermal resistance. This minimum wick thickness for a given vapor chamber device (or individual vapor core within the bottom-tier subunit 14) was dictated by the balance between the total liquid pressure drop ($\Delta P_l$) and the available capillary pressure ($\Delta P_{cap}$). The liquid pressure drop ($\Delta P$) for a given uniform heat input (Q) over the entire evaporator area was estimated by considering a one-dimensional radial flow through the evaporator and the condenser wicks according to Darcy's law for porous materials:

$$\Delta P = \frac{\mu_1 Q}{2\pi_{h1,v}\rho_l K t_{cap}}\left(\ln\left(\frac{d_{cond}}{d_{evap}}\right)+1\right) \tag{10}$$

For the representative nonuniform power map, the liquid pressure drops ($\Delta P_l$) and ($\Delta P_2$) were respectively computed using Eq. (10) from the decomposed uniform heat inputs $Q_1$ and $Q_2$. The total pressure drop of the liquid, employing the principle of linear superposition, was estimated as:

$$\Delta P_1=\Delta P_1+\Delta P_2 \tag{11}$$

The driving capillary pressure head was computed from an effective pore radius of the wick and assuming perfect wettability as:

$$\Delta P_{cap} = \frac{2\sigma_l}{r_{eff}} \tag{12}$$

Owing to their high capillary pressure and effective thermal conductivity, this investigation considered sintered copper particle wicks. The effective pore radius ($T_{eff}$) and the permeability (K) of the wicks were estimated as a function of the wick porosity (e) and the particle diameter (D), as:

$$r_{eff} = 0.21D \tag{13}$$

$$K = \frac{D^2 e^3}{150(1-e)^2} \tag{14}$$

The capillary-limit-governed thickness of the wicks ($t_{cap}$) was obtained by equating $\Delta P_1$ to $\Delta P_{cap}$, and depended on the ratio of the effective pore radius and the permeability of the wicks:

$$\Delta P_l = \tag{15}$$

$$\Delta P_{cap} \Rightarrow t_{cap} = \frac{Q_1 r_{eff}}{4\pi M_l K}\left\{\ln\left(\frac{d_{cond}}{d_{evap}}\right)+1\right\} + \frac{Q_2 r_{eff}}{4\pi M_l K}\left\{\ln\left(\frac{d_{cond}}{d_{hc}}\right)+1\right\}$$

where, $M_l=(\rho_l\sigma_l h_{l,v})/\mu_l$, was the liquid figure of merit. An additional constraint was imposed to ensure that the sintered copper wicks had a minimum thickness of at least three particle diameters. Hence, the wick thickness ($t_{wick}$) became set based on the maximum of either the capillary-limited thickness or this three-particle constraint:

$$t_{wick}=\max(t_{cap},3D) \tag{16}$$

For the vapor chamber device 10, this same design approach was adapted to the individual tiers 12 and 14 by calculating the total pressure drop ($\Delta P_{l,b}$) in the bottom-tier subunit 14 using the decomposed heat inputs $Q_{1,b}$ and $Q_{2,b}$, and equating to the capillary pressure ($\Delta P_{cap,b}$) to design the wick thickness ($t_{wick,b}$). Separately, the balance between the capillary pressure ($\Delta P_{cap,t}$) and the total liquid pressure drop ($\Delta P_{l,t}$) in the top-tier subunit 12, computed with $Q_{1,t}$ and $Q_{2,t}$, was used to design the wick thickness in the top-tier subunit ($t_{wick,t}$).

For each heat spreader type, a parametric optimization investigation was performed to minimize the thermal resistance ($R_{sp}$) for the same equivalent cylindrical design envelope dimensions ($d_{cond,t}$) and power map. FIG. 3 shows the key parameters that were varied for the solid copper device 40, the conventional vapor chamber device 50, and the multi-core vapor chamber device 10, including $d_{evap}$, $d_{cond}$, and t.

The thermal resistance of the solid copper device 40 was governed only by its thickness (t) and cross-sectional area. The minimum resistance was obtained for the trivial case where copper occupies the entire structure.

For the vapor chamber devices 10 and 50, water was considered as the working fluid. Furthermore, the thickness of the copper walls of the housing was neglected, such that the vapor cores 20, 22, and 60 and wick structures 24, 26, and 64 occupy the entire design envelope when comparing their performance with the solid copper device 40. The total thermal resistance was dictated by one-dimensional heat conduction across the wick structures 24, 26, and 64 and heat spreading in the vapor cores 20, 22, and 60. Because the wick thickness was minimized, this determined the vapor core thickness and the associated thermal resistance. The thermal resistance resulting from heat conduction in the wicks ($R_{wick}$) was determined by the effective thermal conductivity of the sintered copper powder, the wick thickness, and the area corresponding to a given heat load ($A_{hl}$). Because the wick thickness was constrained per Eq. (16), these conduction thermal resistances were inherently a function of the porosity, particle diameter, and permeability, as:

$$R_{wick} = \frac{t_{wick}}{k_{wick}} = f(e, D, K) \tag{17}$$

For the conventional vapor chamber 50, because there was only a single core 60, the wick thickness ($t_{wick}$) set the vapor core thickness based on the available total design envelope thickness (t). The vapor core thermal resistance accounted for the in-plane heat spreading and the associated three-dimensional variation in temperature. For the design envelope thickness and power map considered in this investigation, it was experimentally demonstrated that the thermal resistance resulting from the difference in saturation pressure in the vapor core 60 ($R_{vap}$) was always orders lower than the conduction resistance across the wick structure 68 and was therefore neglected. For the parametric optimization investigation, the porosity was varied between 0.42 and 0.6, and the particle diameter was varied between 5 μm and 75 μm, corresponding to the approximate range of reasonable parameters for sintered copper wicks.

For the vapor chamber device 10, the parametric investigation was extended to allow the thicknesses of the individual tiers ($t_t$, $t_b$) to vary within the available design thickness (t). Furthermore, the number and diameter of the secondary vapor cores 22 ($d_{cond,b}$) in the bottom-tier subunit 14 were free to vary and influence the heat flux levels at the evaporator wick of the top-tier subunit 12, which consequently affected the design of the wick thickness ($t_{wick,t}$, $t_{wick,b}$) and the vapor core thicknesses ($t_t$, $t_b$) of the individual tiers 12 and 14. The porosities ($e_t$, $e_b$) and particle diameters ($D_t$, $D_b$) of the wick structures 28 and 30 of the individual tiers 12 and 14 were varied between the same bounds as the conventional vapor chamber device 50. A custom software program executed the reduced-order model throughout the design space to identify the parameters which were believed to offer the lowest thermal resistance.

Figure 7A:
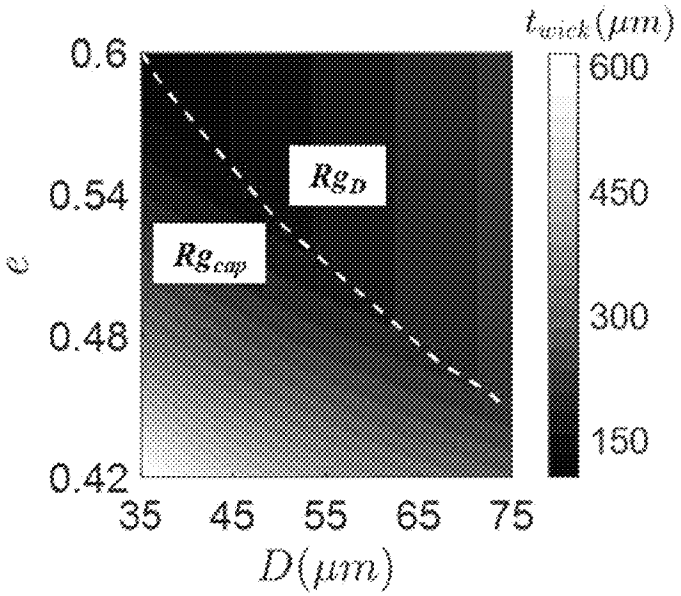
FIGS. 7A and 7B represent wick thickness ($t_{wick}$) and maximum thermal resistance ($R_{sp}$), respectively, for a conventional, single-core vapor chamber device as a function of wick porosity (e) and particle diameter (D) for a total thickness t=2 mm. The regions (Rg) to the left and right of the lighter dashed line correspond to the capillary-limit-governed wick thickness ($Rg_{cap}$: $t_{wick}=t_{cap}$) and the particle diameter-governed wick thickness ($Rg_D$: $t_{wick}=3D$), respectively. The darker dashed line in FIG. 7B denotes the porosity (e) for which the thermal resistance ($R_{sp}$) is at a minimum for any given particle diameter (D). The point believed to be at optimal thermal resistance for a conventional vapor chamber device is denoted by the light dot labeled $R_{sp,opt}$ in FIG. 7B.
Figure 7B:
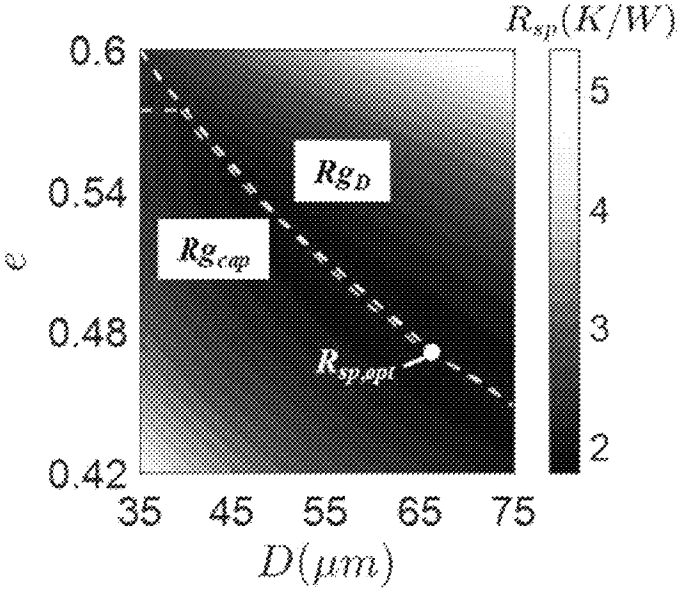
Figure 8A:
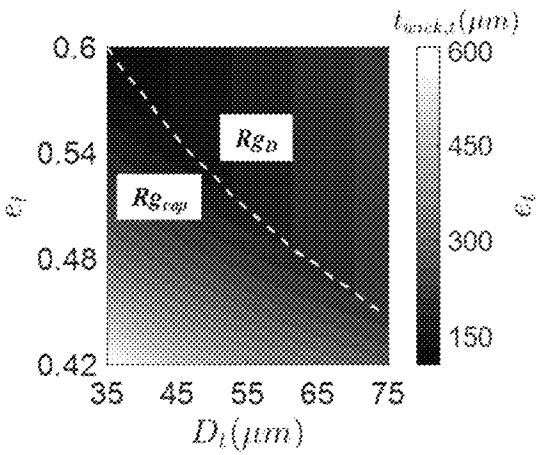
FIGS. 8A through 8D represent wick thicknesses ($t_{wick,t}$, $t_{wick,b}$.
Figure 8B:
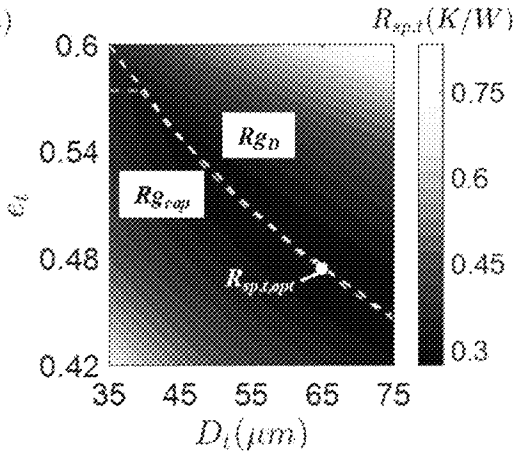
Figure 8C:
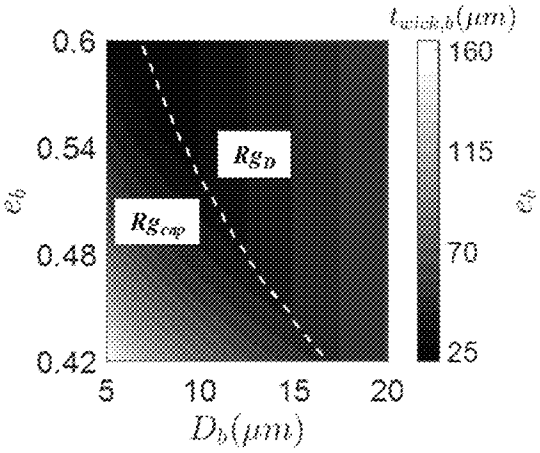
Figure 8D:
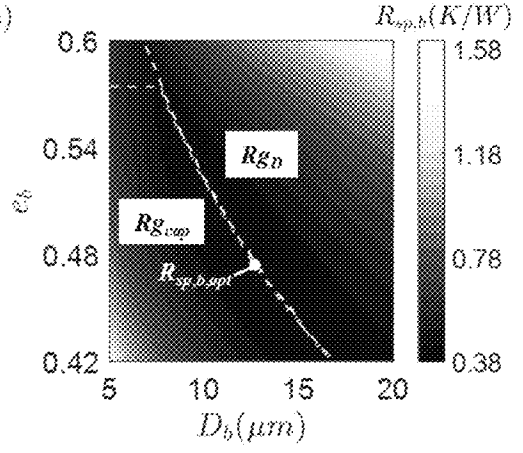

The contour plots represented in FIGS. 7A and 7B depict the variation of the wick thickness ($t_{wick}$) and the measured maximum thermal resistance ($R_{sp}$) of the conventional single-core vapor chamber 50, respectively, as a function of the wick porosity (e) and the particle diameter (D) for the nonuniform power map. In general, the wick thickness reduced with the decrease in particle diameter and the increase in the wick porosity.

For a given particle diameter, there existed a transitional porosity (noted by the dashed lines) above which the designed wick thickness was governed by the particle diameter constraint per Eq. (16) and below which the wick thickness was governed by the capillary limit. This was attributed to a reduction in the capillary-limit-governed wick thickness ($t_{cap}$) because of the increase in the wick permeability. With an increase in the particle diameter, there was a reduction in the driving capillary pressure head ($\Delta P_{cap}$) (see Eq. (12)). Furthermore, the wick permeability increased (see Eq. (14)) with an increase in the particle diameter. Hence, with an increase in the particle diameter, the transition of the design from a capillary-limit-governed wick thickness ($t_{wick}=t_{cap}$) to a particle diameter-governed wick thickness ($t_{wick}=3D$) occurred at a lower wick porosity.

The thermal resistance ($R_{sp}$) of the conventional vapor chamber 50 was dominated by the conduction resistance across the wicks (about $10^4$ times the vapor core thermal resistance). The minimum thermal resistance (dashed line in FIG. 7B) corresponding to a given particle diameter occurred at a constant value of porosity (e=0.57) until D=40 μm. In this region, the thermal resistance ($R_{sp}$) was determined by conduction across the capillary-limit-governed wick thickness. The particular value believed to be of optimum porosity in this region, which offered the minimum resistance, was governed by the tradeoff between an increasing capillary-limited wick thickness and increasing wick thermal conductivity with porosity. For a given particle diameter greater than 40 μm, the designed wick thickness reduced until it became governed by the three-particle diameter constraint, rather than the capillary limit. This reduction in the wick thickness dominated over the decrease in wick thermal conductivity, with an increase in wick porosity from 0.5 until the transitional porosity of 0.57. Consequently, the minimum thermal resistance, in this particle diameter-governed region, was determined by the wick thickness at the transitional porosity (i.e., the point where the dashed lines overlap).

This parametric optimization investigation of the conventional vapor chamber device 50 yielded calculated optimal porosity ($e_{opt}$) of 0.47, particle diameter ($D_{opt}$) of 66 μm, and wick thickness ($t_{wick,opt}$) of 199 μm having a calculated optimized thermal resistance of 1.76 K/W. At the calculated optimum, the thermal resistance was more sensitive to the porosity compared to the particle diameter (e.g., increases to 2.31 K/W versus 1.94 K/W with 10% increase in e and D, respectively). The thermal resistance isocontours shown in FIG. 7B revealed that there was a design window of wick porosities and the particle diameters for which the thermal resistance of the conventional vapor chamber device 50 was near the calculated optimized value (<2 K/W).

FIG. 8 represents variation of the designed wick thicknesses ($t_{wick,t}$ and $t_{wick,b}$) and the thermal resistances ($R_{sp,t}$, $R_{sp,b}$) for the top-tier subunit 12 and bottom-tier subunit 14 of the vapor chamber device 10 ($t_t$=1.4 mm, $t_b$=0.6 mm, $d_{cond,b}$=5.0 mm), for the nonuniform power map. The specific trends within these data followed the same behavior (and interpretation) as previously shown for the single-core vapor chamber device 50 in FIG. 7, but resulted in different calculated optimal parameters for the vapor chamber device 10. What was believed to be the optimized thermal resistance ($R_{sp,t,opt}$=0.27 K/W; $R_{sp,b,opt}$=0.38 K/W) was obtained for the top-tier subunit 12 ($e_{t,opt}$=0.47; $D_{t,opt}$=65 μm; $t_{wick,t,opt}$=195 μm) thickness ($t_{t,opt}$) of 1.4 mm and the bottom-tier subunit 14 ($e_{b,opt}$=0.47; $D_{b,opt}$=13 μm; $t_{wick,b,opt}$=39 μm) vapor core diameter ($d_{cond\ b,opt}$) of 5.0 mm. These calculated wick parameters revealed the need for thinner wicks and lower particle diameters for the bottom-tier subunit 14, relative to the top-tier subunit 14, to avoid the capillary limit. This was attributed to the large total heat loads in the top-tier subunit 12 compared to a single secondary vapor core 22 of the bottom-tier subunit 14. As in the case of the conventional vapor chamber 50, at the calculated optimal wick parameters, the thermal resistance of the individual tiers 12 and 14 was more sensitive to the porosity compared to the particle diameter, and the thermal resistance isocontours shown in FIGS. 8B and 8D revealed design windows of porosities and particle diameters for which the thermal resistance of the tiers 12 and 14 were near their calculated optimized values.

Figure 9:
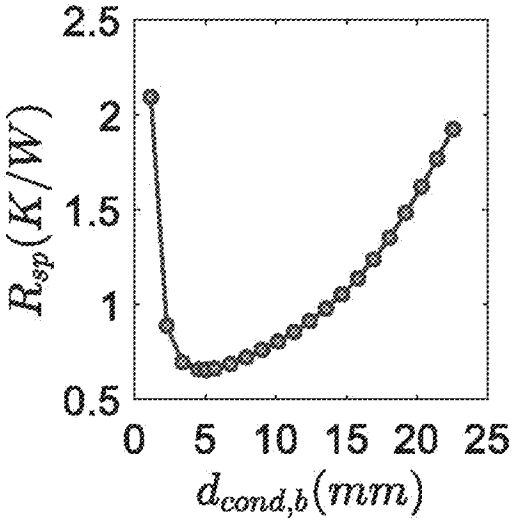
FIG. 9 represents variation of maximum thermal resistance ($R_{sp}$) of the cascaded multi-core vapor chamber device of FIGS. 1, 2, and 3D with a core diameter ($d_{cond,b}$) for a thickness of the bottom-tier subunit tb=0.6 mm. At each core diameter, wick porosities ($e_t$, $e_b$) and the particle diameters ($D_t$, $D_b$) were believed to be optimized.

The dependence of the thermal resistance ($R_{sp}$) of the vapor chamber device 10 on the core diameter ($d_{cond,b}$) is depicted in FIG. 9. Note that for each core diameter, the wick porosities ($e_t$, $e_b$) and particle diameters ($D_t$, $D_b$) were adjusted to obtain a minimum thermal resistance. The results in FIG. 9 were evaluated for a fixed thickness for the bottom-tier subunit 14 of 0.6 mm. However, within a given range of thickness for the bottom-tier subunit 14 (about 0.4 mm<$t_b$<about 1.2 mm), it was confirmed that the calculated optimal thermal resistance ($R_{sp}$) of the vapor chamber device 10 remained nearly invariant for a given core diameter ($d_{cond,b}$). This was attributed to the dominance of the conduction resistance across the wicks relative to the vapor core thermal resistance in that range.

With an increase in the core diameter ($d_{cond,b}$), there was an increase in the calculated optimum thermal resistance of the bottom-tier subunit 14 ($R_{sp,b,opt}$). However, there was a simultaneous reduction in the calculated optimum thermal resistance of the top-tier subunit 12 ($R_{sp,t,opt}$) and an increase in the heat input ($Q_{chs}$) at the secondary vapor core of the bottom-tier subunit 14 above the hotspot. Consequently, the calculated optimal core diameter was governed by this tradeoff. Nevertheless, the results represented in FIG. 9 indicated that the thermal performance of the vapor chamber device 10 was not overly sensitive to the core diameter for the power map investigated, having a wide range from about 3.4 mm<$d_{cond,b}$<about 7.9 mm where the thermal resistance was within 10% of the calculated optimum, which is attractive from a design and fabrication standpoint in that it may be adjusted for various applications.

Figure 10:
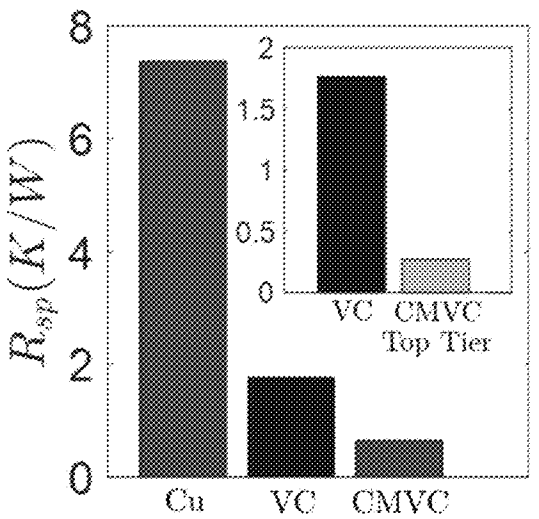
FIG. 10 represents a comparison of heat spreader thermal resistance for the solid copper device of FIG. 3B, the conventional single-core vapor chamber device of FIG. 3C, and the cascaded multi-core vapor chamber device of FIGS. 1, 2, and 3D. The inset shows a significant reduction in the thermal resistance of the top-tier subunit from the conventional single-core vapor chamber device of FIG. 3C to the cascaded multi-core vapor chamber device of FIGS. 1, 2, and 3D.

FIG. 10 compares the predicted thermal resistance of the vapor chamber device 10 to the conventional vapor chamber device 50 and the solid copper device 40. The thermal resistance was largest (7.38 K/W) for the solid copper device 40, and the conventional vapor chamber device 50 offered a reduction to (1.76 K/W). This was attributed to a significant reduction in the thermal resistance of the vapor core 60, compared to the conduction spreading resistance in solid copper. This significant reduction in thermal spreading resistance from solid copper to the vapor core 60 was able to overcompensate for the penalty of the additional through-plane conduction resistance of the porous wick structure 68 of the conventional vapor chamber device 50. From the conventional vapor chamber device 50 to the vapor chamber device 10, there was a further significant reduction in the total thermal resistance to 0.66 K/W. In the vapor chamber device 10, the local damping of the hotspot flux densities by the bottom-tier subunit 14 resulted in an order of magnitude reduction of thermal resistance from 1.76 K/W for the conventional vapor chamber device 50 to only 0.27 K/W (see FIG. 10 inset) for the top-tier subunit 12 of the vapor chamber device 10. The presence of multiple secondary vapor cores 22 in the bottom-tier subunit 14 resulted in a high capillary limit of the individual secondary vapor cores 22. Consequently, this enabled significantly thinner wicks having a lowered conduction resistance. Hence, the bottom-tier subunit 14 could spread hotspots at a low thermal resistance of 0.4 K/W. Hence, there was a net overall decrease considering both the top-tier subunit 12 and bottom-tier subunit 14 in the vapor chamber device 10.

Figure 5A:
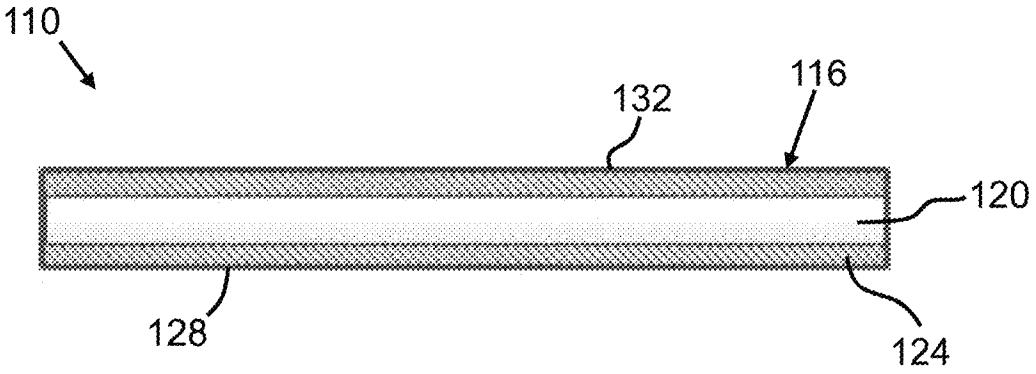
FIGS. 5A and 5B schematically represent cross-sectional views of two heat spreaders: a standalone vapor chamber device (FIG. 5A), and a vapor chamber device interfaced with a buffer vapor chamber device (FIG. 5B).
Figure 5B:
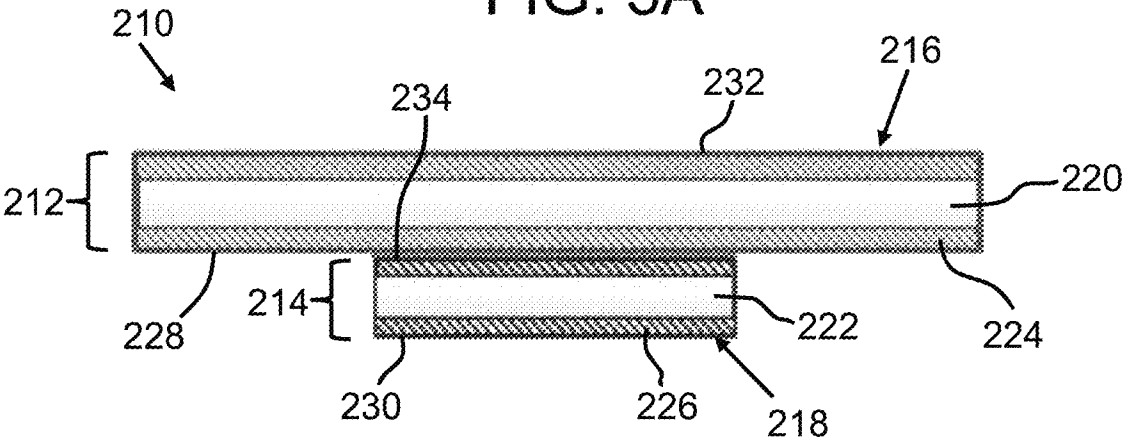

In another investigation leading to aspects of the present invention, it was demonstrated that the thermal resistance of a conventional vapor chamber device (e.g., analogous to the top-tier subunit 12) can be significantly reduced by the introduction of a buffer vapor chamber device (e.g., analogous to the bottom-tier subunit 14) placed below the conventional vapor chamber device to diffuse hotspots. This was achieved by characterizing the thermal resistance of a first vapor chamber device 110 that included a single vapor core 120, and a second vapor chamber device 210 having a cascading multi-core unit that included a top-tier subunit 212 having a single vapor core 220 that was identical to the vapor core 120 and a smaller footprint bottom-tier subunit 214 that included a single vapor core 222 interfaced to the top-tier subunit 212 to act as a buffer. FIG. 5A represents the cross-sections of the first and second vapor chamber devices 110 and 210. The testing was performed using commercially available vapor chamber devices having dimensions 90 mm×90 mm×3 mm (345-1564-ND, Wakefield Vette) and 30 mm×30 mm×3 mm (Novark). Note these were both commercially available vapor chambers and did not have the specific architecture of the vapor chamber device 10 discussed above. The testing setup and parameters are described in detail in Bandyopadhyay et al., "A cascaded multi-core vapor chamber for intra-lid heat spreading in heterogeneous packages," 19th IEEE Intersociety Conference on Thermal and Thermomechanical Phenomena in Electronic Systems (ITherm) IEEE (July 2020), the contents of which are incorporated herein in their entirety.

Figure 6:
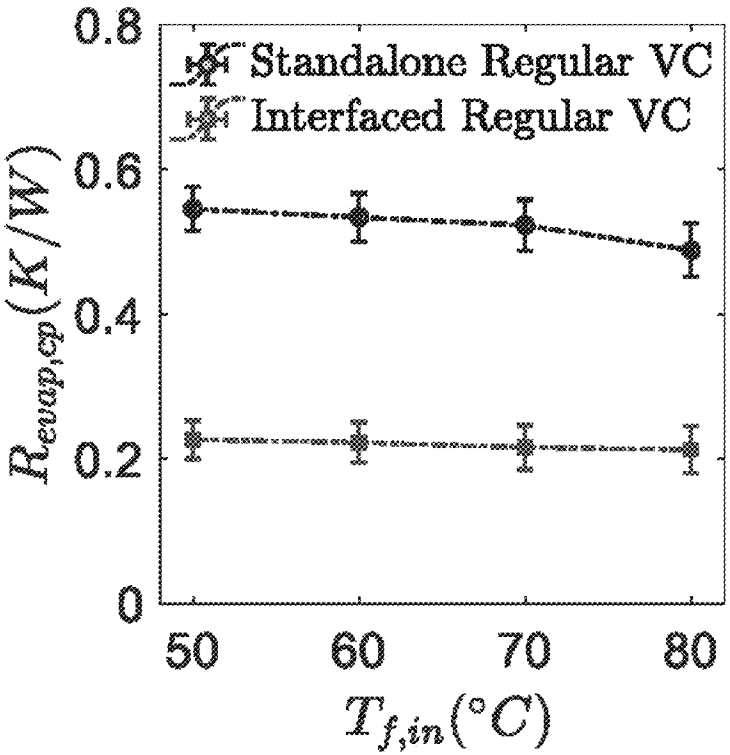
FIG. 6 represents measured thermal resistance for the standalone vapor chamber device of FIG. 5A compared to the vapor chamber device interfaced with the buffer vapor chamber device. The addition of the buffer vapor chamber device was observed to reduce the thermal resistance of the vapor chamber device.

FIG. 6 represents the measured thermal resistance as a function of the recirculating bath fluid temperature for the two test cases shown in FIG. 5A. This measured thermal resistance for both the first vapor chamber device 110 (upper dashed line) and the second vapor chamber device 210 (lower dashed line) was observed to be independent of the operating temperature (within the uncertainty limits) for the range tested. This was attributed to the dominance of the temperature-independent conduction resistances across the wicks relative to the vapor core thermal resistance. Notably, the vapor chamber thermal resistance of 0.52 K/W (corresponding to a temperature difference of 9.7° C. at the input heat load of 18.5 W) reduced significantly when the buffer bottom-tier subunit 214 was introduced to 0.22 K/W (a difference of 4.0° C. at 18.2 W). This indicated that the bottom-tier subunit 214 effectively spread out the heat load before it entered the top-tier subunit 214 above. This result supported the design rationale of the multi-core vapor chamber device 10, as it confirmed the effectiveness of a buffer vapor chamber in damping the heat flux to improve the performance of a top vapor chamber, even from this 10 mm×10 mm heat input area, and have promise for further improvements for smaller hotspots.

The above investigations evaluated the performance sensitivity to a range of parameters for the vapor chamber device 10 and thereby offered new insight into the flexibility of design in the context of manufacturing and subsequent intra-lid integration in an electronic package. Separately, the investigations demonstrated that the thermal resistance of a given commercial vapor chamber device can be reduced by interfacing it with another buffer vapor chamber device placed between the commercial vapor chamber device and the heat source. This demonstration confirmed a key benefit of the vapor chamber device 10, that a performance improvement can be achieved in the top-tier subunit 12 via a reduction in the conduction resistances across the internal wick structure 24.

While the invention has been described in terms of specific embodiments, it is apparent that other forms could be adopted by one skilled in the art. For example, the physical configurations of cascaded multi-core vapor chamber devices within the scope of the invention can differ from that shown, and materials and processes/methods other than those noted could be used. In addition, the invention encompasses additional embodiments in which one or more features or aspects of different disclosed embodiments may be omitted or combined. Therefore, the scope of the invention is to be limited only by the following claims.

The invention claimed is:

1. A vapor chamber device comprising:

a first subunit including a first sealed cavity lined on an interior thereof by a first porous wick structure defining a first vapor core, the first subunit configured to passively spread heat from a first input area to a first output area;

a second subunit having walls enclosing a second sealed cavity, the cavity lined on an interior thereof by a second porous wick structure where the porous wick structure defines a plurality of second vapor cores individually separated from each other by continuous dividing walls formed by the second porous wick structure, the second subunit configured to passively spread heat from a second input area to a second output area in thermal contact with the first input area of the first subunit;

a first working fluid within the first vapor core; and a second working fluid within each individual second vapor core of the plurality of second vapor cores;

wherein each individual second vapor core of the plurality of second vapor cores is configured to receive heat from the second input area so as to vaporize the second working fluid therein and dissipate the heat through the second output area and into the first input area and to damp the local hot spots on the second input area by spreading the heat to an area on the second output area approximately the size of the respective second vapor core;

wherein flow of vapor within the plurality of second vapor cores is only through each individual second vapor core from the second input area to the second output area due to the continuous dividing walls preventing flow of the vapor between adjacent ones of the second vapor cores; and wherein the first subunit and the second subunit are sealed from each other and hydraulically independent, and the second subunit is configured to attenuate high heat flux hotspots on the second input area before the heat fluxes thereof pass through the second output area of the second subunit to the first input area of the first subunit.

2. The vapor chamber of claim 1, wherein the second internal porous wick structure has a dimension between the second input area and the second output area that is less than a dimension of the first internal porous wick structure in a direction from the first input area to the first output area.

3. The vapor chamber device of claim 1, wherein the second internal porous wick structure has a particle diameter that is less than the particle diameter of the first internal porous wick structure.

4. The vapor chamber device of claim 1, wherein the second internal porous wick structure has a path of return for the second working fluid within the second subunit in a direction from the second output area to the second input area that is smaller than a path of return for the first working fluid within the first subunit of the first internal porous wick structure in a direction from the first output area to the first input area.

5. A vapor chamber device having a cascaded multi-core unit comprising:

a top-tier subunit comprising a first sealed cavity lined on an interior thereof by a first porous wick structure that defines a single, first vapor core configured to generate a capillary pressure to recirculate a first working fluid therein and thereby passively spread heat from a first input area to a first output area of the top-tier subunit; and a bottom-tier subunit comprising a second sealed cavity lined on an interior thereof by a second porous wick structure that defines a plurality of second vapor cores individually separated from each other by continuous dividing walls formed by the second porous wick structure, each of the plurality of second vapor cores being configured to generate a capillary pressure to recirculate a second working fluid therein and thereby passively spread heat from a second input area to a second output area of the bottom-tier subunit and to damp the local hot spots on the second input area by spreading the heat to an area on the second output area approximately the size of the respective second vapor core;

wherein each individual second vapor core of the plurality of second vapor cores is configured to receive heat from the second input area so as to vaporize the second working fluid therein and dissipate the heat through the second output area and into the first input area;

wherein flow of vapor within the plurality of second vapor cores is only through each individual second vapor core from the second input area to the second output area due to the continuous dividing walls preventing flow of the vapor between adjacent ones of the second vapor cores; and wherein the second output area of the bottom-tier subunit is thermally coupled to the first input area of the top-tier subunit, and wherein the second vapor core is configured to attenuate high heat flux hotspots before the heat fluxes thereof pass through the second output area of the bottom-tier subunit to the first input area of the top-tier subunit.

6. The vapor chamber device of claim 5, wherein the top-tier and bottom-tier subunits are thermally coupled, sealed from each other, and hydraulically independent.

7. The vapor chamber device of claim 5, wherein the first working fluid of the top-tier subunit and the second working fluid of the bottom-tier subunit are separate working fluids.

8. A method of dissipating heat from a surface, the method comprising:

locating a vapor chamber device onto the surface, the vapor chamber device having a cascaded multi-core unit comprising a top-tier subunit comprising a first sealed cavity lined on an interior thereof by a first porous wick structure that defines a single, first vapor core containing a first working fluid therein, and a bottom-tier subunit comprising a second sealed cavity lined on an interior thereof by a second porous wick structure that defines a plurality of second vapor cores individually separated from each other by continuous dividing walls formed by the second porous wick structure, the second porous wick structure containing a second working fluid therein;

conducting heat from the surface to a second input area of the bottom-tier subunit and thereby vaporizing the second working fluid within at least one of the plurality of second vapor cores and rejecting heat from a second output area of the bottom-tier subunit and thereby condensing the second working fluid within the bottom-tier subunit, wherein each individual second vapor core of the plurality of second vapor cores is configured to receive the heat from the second input area so as to vaporize the second working fluid therein and dissipate the heat through the second output area;

generating a capillary pressure within the bottom-tier subunit to recirculate the second working fluid therein and thereby passively spread heat from the second input area to the second output area of the bottom-tier subunit;

damping local hot spots on the second input area by spreading the heat to an area on the second output area approximately the size of the respective second vapor core, wherein flow of vapor within the plurality of second vapor cores is only through each individual second vapor core from the second input area to the second output area due to the continuous dividing walls preventing flow of the vapor between adjacent ones of the second vapor cores;

conducting heat from the second output area of the bottom-tier subunit to a first input area of the top-tier subunit and thereby vaporizing the first working fluid within the first vapor core and rejecting heat from a first output area of the top-tier subunit and thereby condensing the first working fluid within the top-tier subunit;

generating a capillary pressure within the top-tier subunit to recirculate the first working fluid therein and thereby passively spread heat from the first input area to the first output area of the top-tier subunit; and attenuating high heat flux hotspots on the surface with the bottom-tier subunit before the heat fluxes thereof pass through the second output area of the bottom-tier subunit to the first input area of the top-tier subunit.

9. The vapor chamber device of claim 5, wherein the second porous wick structure of the bottom-tier subunit has a particle diameter that is less than the particle diameter of the first porous wick structure of the top-tier subunit.

10. The vapor chamber device of claim 5, wherein the second porous wick structure of the bottom-tier subunit has a path of return for the second working fluid from the second output area to the second input area that is shorter than a path of return for the first working fluid of the first porous wick structure of the top-tier subunit from the first output area to the first input area.

11. The vapor chamber device of claim 5, wherein first and second porous wick structures of the top-tier and bottom-tier subunits include first and second evaporator wicks, respectively, and the second evaporator wick is thinner than the first evaporator wick.

* * * * *